US005240322A

United States Patent [19]

Haber et al.

[11] Patent Number: 5,240,322

[45] Date of Patent: Aug. 31, 1993

[54] PHARMACEUTICAL MIXING CONTAINER WITH ROTATABLE VANED INTERNAL MAGNETIC MIXING ELEMENT

[75] Inventors: Terry M. Haber, Lake Forest; Clark B. Foster, Laguna Niguel; William H. Smedley, Lake Elsinore, all of Calif.

[73] Assignee: Habley Medical Technology Corporation, Laguna Hills, Calif.

[21] Appl. No.: 949,607

[22] Filed: Sep. 23, 1992

[51] Int. Cl.[5] ..... B01F 13/08

[52] U.S. Cl. ..... 366/130; 206/219; 206/221; 215/DIG. 8; 366/247; 366/273; 366/347; 604/416; 604/903

[58] Field of Search ..... 366/129, 130, 244, 245, 366/247, 273, 274, 314, 342, 343, 347; 215/228, 231, 247, DIG. 3, DIG. 8; 604/201, 228, 232, 416, 903; 206/219, 221

[56] References Cited

U.S. PATENT DOCUMENTS

| | | | |
|---|---|---|---|
| 2,350,534 | 6/1944 | Rosinger | 366/274 |
| 2,449,968 | 9/1948 | Smith | 604/416 |
| 2,842,126 | 7/1958 | Brown | 604/201 |
| 2,887,108 | 5/1959 | Kendall | 604/201 X |
| 2,922,419 | 1/1960 | Bednarz | 604/201 |
| 2,958,517 | 11/1960 | Harker et al. | 366/273 X |
| 3,356,346 | 12/1967 | Landsberger | 366/274 |
| 3,477,431 | 11/1969 | Walecka | 206/221 X |
| 3,622,129 | 11/1971 | Mazowski | 366/247 |
| 3,789,670 | 2/1974 | Rosenwald | 366/273 X |
| 4,289,648 | 9/1981 | Hoskins et al. | 604/416 X |
| 4,445,895 | 5/1984 | Margulies | 604/201 X |
| 4,850,986 | 7/1989 | Grau et al. . | |
| 5,137,528 | 8/1992 | Crose | 604/232 X |

FOREIGN PATENT DOCUMENTS

| | | | |
|---|---|---|---|
| 3344754 | 6/1985 | Fed. Rep. of Germany | 366/273 |

*Primary Examiner*—Harvey C. Hornsby
*Assistant Examiner*—Charles Cooley
*Attorney, Agent, or Firm*—Townsend and Townsend Khourie and Crew

[57] ABSTRACT

A pharmaceutical mixing container for storing a liquid having at least two factions which tend to separate during storage. A housing has an inner volume and is closed at one end by a septum arrangement and at another end by a slidable sealing member. A vaned mixing member having a magnetic element is loosely rotatably mounted within the housing in a first recess formed in the inner volume facing portion of the sealing member and contacts the liquid faction of the pharmaceutical contained within the housing. An external magnet produces a magnetic field which extends within the inner volume and interacts with the mixing element. By rotating the magnet about the axis of the housing, the mixing member is rotated by the magnetic coupling causing turbulent waves within the liquid which provide thorough admixing for the pharmaceutical constituents. The external magnet is carried by a drive stem which engages with the sealing member and can be used to expel the mixed pharmaceutical after the septum is pierced. By controlling the speed of rotation of the magnet, thorough admixing is provided without causing mechanical damage to delicate constituents, such as crystalline factions found in NPH type insulin.

16 Claims, 3 Drawing Sheets

PHARMACEUTICAL MIXING CONTAINER WITH ROTATABLE VANED INTERNAL MAGNETIC MIXING ELEMENT

BACKGROUND OF THE INVENTION

This invention relates to containers for liquids . having a miscible component. More particularly, this invention relates to mixing containers for storing a liquid pharmaceutical.

Containers are known for storing a pharmaceutical having a liquid component and a second component miscible with a liquid component. A typical container of this type is filled with the pharmaceutical and stored for later use. Some pharmaceuticals separate into their individual components when left in storage. For example, liquid NPH insulin has a crystalline faction which must be in solution in order to be effectively administered. During storage in a container, such crystals precipitate out of the liquid solution and must be thoroughly mixed with the liquid faction just prior to administration. Admixture of the crystalline faction and the liquid faction has been achieved in the past in a number of different ways. One such technique is to provide a mixing element which is freely moveable within the container, in a similar manner to the mixing ball found in ordinary aerosol spray cans. This solution has been found to be less than desirable, since the crystalline faction is composed of delicate crystals which should not be ruptured during the mixing process. The use of a freely moveable mixing element within the container, however, has been found to rupture the crystals, which severely impairs the effectiveness of the pharmaceutical. Efforts in the past to provide a pharmaceutical mixing container devoid of the above disadvantage have not been successful to date.

SUMMARY OF THE INVENTION

The invention comprises a pharmaceutical mixing container with a controllably moveable element contained therein which is capable of providing relatively gentle mixing action to thoroughly admix separated components in a pharmaceutical without mechanically damaging those components.

A pharmaceutical mixing container for storing a liquid having at least two miscible components includes a housing having a first end, a second end and a wall structure defining an inner volume, the housing preferably having cylindrical geometry. A closure member providing a fluid seal is arranged at the first end of the housing, the closure member preferably including a septum and a retaining band for securing the septum to the first end of the housing. A sealing member is positioned at least partially within the housing, preferably adjacent the second end, and provides a second fluid seal for containing the liquid within the housing. A mixing member is rotatably mounted within the inner volume of the housing, the member being pivotally carried by the sealing member. The mixing element is provided with at least one, and preferably several, mixing vanes which contact the liquid within the inner volume of the container. The mixing element further includes a magnetic element which is magnetically interactive with a magnetic member. A magnetic field generating means is located externally of the inner volume of the container. The magnetic field generating means preferably comprises a permanent magnet dimensioned to provide magnetic coupling with the mixing element when brought into close proximity to the sealing member. When the magnetic field generating means is in the magnetic coupling position, rotation of the magnetic field generating means about the axis of rotation of the mixing element causes the mixing element to rotate in the liquid to create waves within the liquid. In the preferred embodiment, the housing is cylindrical, the axis of rotation of the mixing element lies along the cylinder axis, and the magnetic field generating means is mounted on a drive stem which mates with a recess in the sealing member. This permits the mixing element to be readily rotated about the housing axis to provide thorough admixing of the pharmaceutical constituent ingredients.

In use, the liquid is stored within the container and is admixed prior to administration by imparting motion to the mixing element by first bringing the magnetic field generating means into close proximity with the sealing member and then manually rotating the external magnetic field generating means. As the magnetic member is correspondingly rotated, the mixing member vanes cause turbulence within the liquid, thereby admixing the constituent ingredients. Since the velocity of rotation of the mixing member is controlled by the user, mechanical damage to the constituents being admixed is minimized or eliminated by rotating the mixing member at a gentle rate.

The liquid may be hydraulically withdrawn from the inner volume of the housing by penetrating the system with a needle cannula of a syringe and subsequently operating the syringe. The liquid may also be expelled from the inner volume of the housing by penetrating the septum with a double point needle and forcibly ejecting the liquid using a drive stem coupled to the sealing member and translating the sealing member with the drive stem in the direction of the first end. In the preferred embodiment the magnetic field generating means is incorporated with the drive stem to make the invention even simpler and more compact.

While the invention may be employed with a wide variety of miscible pharmaceutical components, it is ideally suited for use with pharmaceuticals having a liquid faction and a crystalline faction requiring admixture prior to use. In particular, the manually controllable gentle mixing afforded by the mixing member and the magnetic field generating means is sufficient to thoroughly admix the constituents without damaging the crystal structure.

For a fuller understanding of the nature and advantages of the invention, reference should be had to the ensuing detailed description taken in conjunction with the accompanying drawings.

DESCRIPTION OF THE PREFERRED EMBODIMENTS

Figure 1:
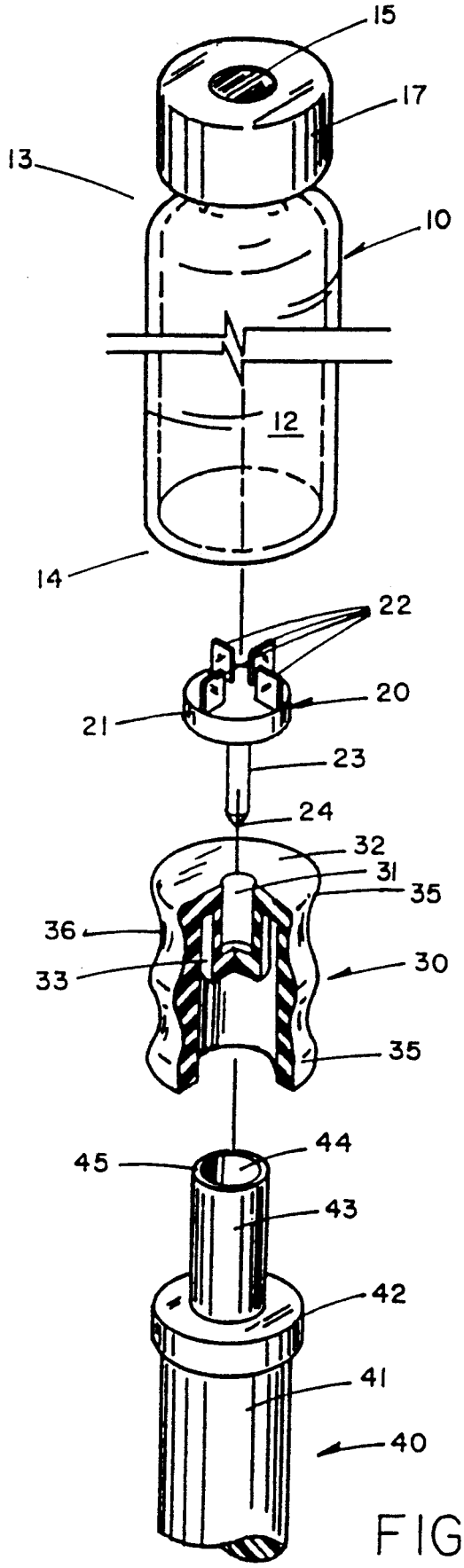
FIG. 1 is an exploded perspective view showing the preferred embodiment of the invention.

Turning now to the drawings, FIG. 1 illustrates a preferred embodiment of the invention. As seen in this Fig., a housing generally designated with reference numeral 10 has a generally cylindrical geometrical configuration defining an inner volume 12, a distal end 13 and a proximal end 14. Housing 10 may be fabricated from glass or any suitable plastic material which is compatible with the pharmaceutical to be contained therewithin. Secured to distal end 13 is a closure member comprising an elastomeric septum 15 which is retained to first end 13 by means of a metal band 17. Septum 15 and band 17 are fabricated and arranged in such a manner that access to the inner volume 12 may be gained by penetrating the band 17 and septum 15 with a needle-like probe, such as a needle cannula of a syringe or a double point syringe needle.

Figure 2:
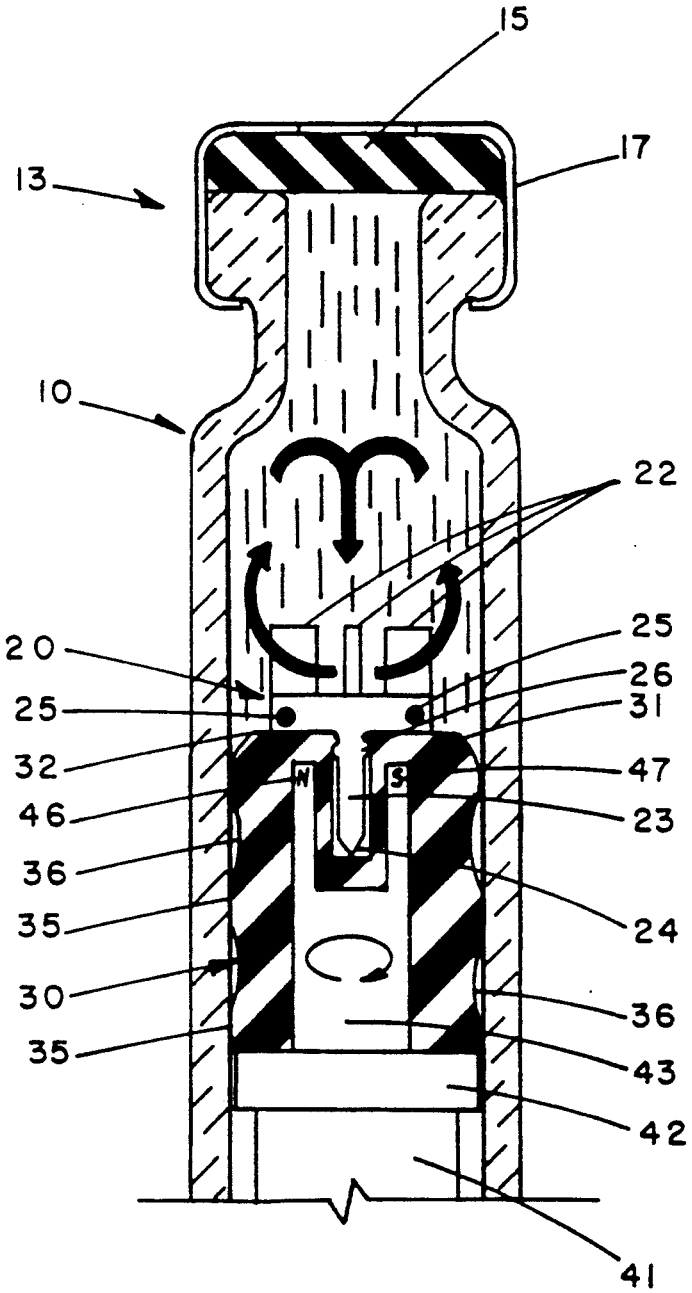
FIG. 2 is a sectional view of the assembled device showing the upper portion of the housing with the mixing element and sealing member in the normal mixing position.
Figure 3:
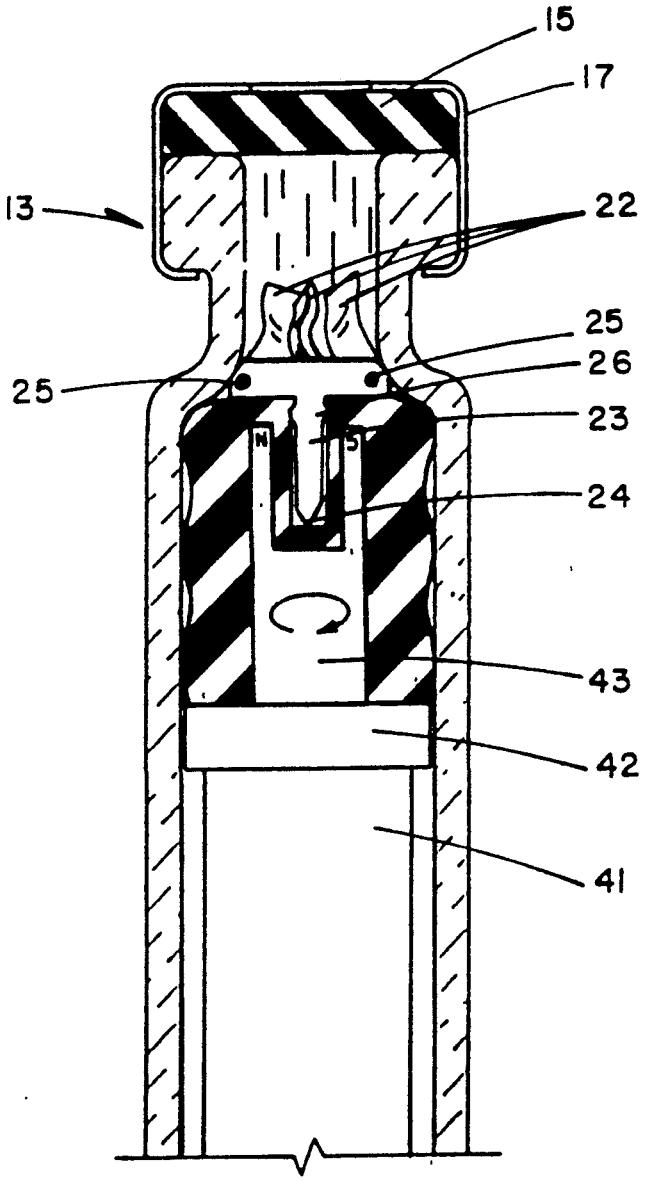
FIG. 3 is a sectional view similar to FIG. 2 showing the mixing element and sealing member in the extended position.

A mixing member generally designated with reference numeral 20 is contained within inner volume 12. Mixing member 20 includes a base portion 21, a plurality of upstanding mixing vanes 22 and a downwardly extending pivot post 23 terminating in a tapered pivot end 24. As best seen in FIGS. 2 and 3, mixing member 20 is provided with a magnetic element component 25 for enabling the mixing member 20 to be driven magnetically by an external magnet. The structure and size of mixing member 20 are selected in such a manner that the member 20 will create sufficient turbulence when rotated within container 10 in the manner described below to thoroughly admix the pharmaceutical constituents to be contained within volume 12.

Mixing member 20 is pivotably supported by a sealing member generally designated with reference numeral 30 Sealing member 30 has a first recess 31 centrally located along the surface 32 facing the inner volume 12 of container 10. Recess 31 has an inner diameter which is slightly larger than the outer diameter of pivot post 23, so that pivot post 23 is free to rotate within recess 31 when driven in the manner described below. Preferably, pivot post 23 is provided with an outwardly extending circumferential ridge 26 (FIGS. 2 and 3) which provides a frictional force sufficiently strong to retain pivot post 23 within recess 31 during jarring motion and which also provides axial stability to the mixing member during rotation.

Sealing member 30 is provided with a second recess 33 in the form of an annulus defined by a downwardly extending central portion used also to provide first recess 31. Second recess 33 accommodates a magnetic field generating means, described below, which is used to rotationally drive mixing member 20 through magnetic coupling.

Sealing member 30 has an outer diameter providing a sealing engagement with the inner walls of housing 10 and is preferably installed adjacent the proximal end 14 of housing 10. Sealing member 30 may be fabricated from a wide variety of suitable materials, such as butyl rubber, silicone rubber or the equivalent. In addition to supporting mixing member 20, sealing member 30 functions to provide a fluid seal for the lower end of inner volume 12. To this end, sealing member 30 is provided with a plurality of crests 35 and troughs 36 along the outer surface thereof.

A drive member generally designated with reference numeral 40 has a main body portion 41, an upper drive collar portion 42 with a sliqhtly enlarged diameter, and a drivinq end 43 of reduced diameter with a central recess 44. The dimensions of driving end 43 are selected so that the upper portion can be received within second recess 33 of sealing member 30. (See FIGS. 2 and 3.) At least one pair of magnetic poles 46,47 (see FIGS. 2 and 3) is provided adjacent the driving end face 45 of drive member 40. Magnetic poles 46, 47 may be formed in any suitable fashion, such as by forming driving end 43 of a permanently magnetizable material and magnetically polarizing same, installing discrete magnets onto a non-magnetizable carrier material, mixing magnetizable material in a rubber matrix, or the equivalent. The polar structure should provide a magnetic field sufficiently strong to extend through the intervening portion of sealing member 30 and provide a magnetic coupling with mixing member 20 to enable rotation of mixing member 20 using the magnetic force.

In use, the mixing member pivot post 23 is placed within recess 31, and sealing member 30 is installed from the proximal end 14 of housing 10. The inner volume 12 is then filled with the pharmaceutical liquid, and septum 15 and closure band 17 are installed to seal volume 12.

When the pharmaceutical is to be administered, the driving end 43 of drive member 40 is inserted into the hollow interior of sealing member 30 and advanced until the upper portion of driving end 43 is nestled within second recess 33. In this position the mixing member 20 is magnetically coupled to the driving end 43. When the drive member 40 is rotated, the mixing element 20 is also rotated. During rotation, the mixing member 20 pivots about the pivot end 24 and ridge 26 rides along the confronting wall surface of first recess 31. As mixing member 20 rotates, the vanes 22 create turbulent waves within the liquid. The two oppositely facing arrows in FIG. 2 suggest rotational motion about the pivot axis in opposite directions, while the remaining arrow suggests a return flow to vanes 22. By manually controlling the rate at which drive member 40 is rotated, the velocity of mixing member 20 is correspondingly controlled. Due to the turbulence created within the liquid the constituent ingredients are thoroughly admixed. After thorough admixture, the liquid can be administered in one of two ways. In a first procedure, the septum 15 is penetrated by means of a needle cannula of a syringe and the liquid is withdrawn from inner volume 12. In a second procedure, the septum is penetrated by a double point needle, and drive member 40 is driven upwardly as viewed in the Figs. to expel the liquid. As seen in FIG. 3, the vanes 22 deform when the restricted upper end of container 10 is encountered.

Mixing member may be fabricated from any suitable inert and non-toxic material capable of being fabricated to the form illustrated. Base portion 21, e.g., can be molded polypropylene or some other moldable plastic material. Vanes 22 are preferably fabricated integrally with base portion 21 and should be sufficiently stiff to provide effective turbulent wave generation yet flexible enough to deform in the manner illustrated in FIG. 3 when surface obstacles are encountered during movement within inner volume 12. Pivot post 23 should be sufficiently stiff to support the mixing element 20 and provide a low sliding friction with those surface portions of sealing member 30 which pivot post 23 contacts during rotation.

As will now be apparent, the magnet and mixing members are capable of providing thorough admixture of the pharmaceutical constituent ingredients in a relatively simple and expedient fashion. In addition, the container fabricated according to the invention is relatively simple and inexpensive to manufacture, can be readily filled with the appropriate liquid pharmaceutical, and can easily be employed for administering the pharmaceutical to a patient.

While the above provides a full and complete disclosure of the preferred embodiments of the invention, various modifications, alternate constructions and equivalents may occur to those skilled in the art. Therefore, the above descriptions should not be construed as limiting the scope of the invention, which is defined by the appended claims.

What is claimed is:

1. A pharmaceutical mixing container for storing liquid with a miscible component, said container comprising:

a housing having a first end, a second end and a wall structure defining an inner volume;

a closure member at said first end providing a fluid seal;

means for providing a second fluid seal so that said inner volume is closed, said means being located within said housing and having an internal recess accessible from the outside of said housing;

a mixing member mounted within said inner volume and rotatably coupled to said second fluid seal said mixing member having at least one mixing vane and being controllable by a magnetic field; and magnetic field generating means adapted to be positioned within said internal recess and adjacent said mixing member wherein rotation of said magnetic field generating means when positioned within magnetic coupling range of said mixing member causes said mixing member to be rotated within said housing to admix any liquid and miscible component contained therein.

2. The invention of claim 1 wherein said mixing member includes a plurality of mixing vanes.

3. The invention of claim 1 wherein said mixing member includes a base member and wherein said at least one mixing vane extends outwardly from said base member.

4. The invention of claim 3 wherein said base member includes a pivot post extending downwardly therefrom; and wherein said second fluid seal providing means includes a recess for receiving at least a portion of said pivot post.

5. The invention of claim 1 wherein said mixing member includes a magnetic portion fabricated from a material selected from the group consisting of ferrous oxides, steel, rare earth elements and a magnetic agent intermixing with a matrix material selected from the group consisting of rubber or plastic.

6. The invention of claim 1 wherein said magnetic field generating means comprises a permanent magnet.

7. The invention of claim 1 wherein said closure member comprises a septum.

8. The invention of claim 7 wherein said closure member further includes a retaining band.

9. The invention of claim 1 wherein said housing has cylindrical geometry.

10. The invention of claim 1 wherein said means for providing a second fluid seal is located adjacent said second end.

11. The invention of claim 1 wherein said second fluid seal providing means comprises a sealing member located at least partially within said housing.

12. The invention of claim 11 further including means for enabling the liquid within the container to be ejected from said first end when said closure member is opened.

13. The invention of claim 12 wherein said sealing member is slidably received in said housing; and wherein said enabling means comprises a drive stem coupled to said sealing member.

14. The invention of claim 13 wherein said magnetic field generating means comprises a magnet located adjacent one end of said drive stem.

15. The invention of claim 1 wherein said at least one mixing vane is fabricated from a flexible material sufficiently stiff to provide effective turbulent wave generation within said liquid and sufficiently flexible to deform when contacting said wall structure.

16. A pharmaceutical mixing container for storing a liquid with a miscible component, said container comprising:

a housing having a first end, a second end and a wall structure defining an inner volume;

a closure member at said first end providing a fluid seal;

a sealing member located at least partially within said housing for providing a second fluid seal so that said inner volume is closed, said sealing member being slidably received in said housing;

a mixing member mounted within said inner volume and rotatably coupled to said second fluid seal, said mixing member having at least one mixing vane and being controllable by a magnetic field;

magnetic field generating means adapted to be positioned adjacent said mixing member, wherein rotation of said magnetic field generating means when positioned within magnetic coupling range of said mixing member causes said mixing member to be rotated within said housing to admix any liquid and miscible component contained therein; and means for enabling the liquid within the container to be ejected from said first end when said closure member is opened, said enabling means comprising a drive stem coupled to said sealing member, said magnetic field generating means comprising a magnet located adjacent one end of said drive stem.

* * * * *